US007694467B2

(12) United States Patent
Lin

(10) Patent No.: US 7,694,467 B2
(45) Date of Patent: Apr. 13, 2010

(54) ROOF VENTILATION ASSEMBLY

(76) Inventor: Chin-Yi Lin, No. 19, Jhensing Rd., Gueishan Hsiang, Taoyuan Hsien (TW)

( * ) Notice: Subject to any disclaimer, the term of this patent is extended or adjusted under 35 U.S.C. 154(b) by 115 days.

(21) Appl. No.: 12/007,707

(22) Filed: Jan. 15, 2008

(65) Prior Publication Data

US 2009/0178351 A1 Jul. 16, 2009

(51) Int. Cl.
*E04D 13/17* (2006.01)
*E04D 13/143* (2006.01)
*E04B 7/18* (2006.01)

(52) U.S. Cl. ..... 52/199; 454/364; 454/365

(58) Field of Classification Search ..... 52/84, 52/90.1, 95, 198, 199, 270, 302.1, 302.3, 52/503, 553, 606, 633, 636; 454/228, 254, 454/260, 339, 341, 356, 358, 364, 365, 366, 454/367, 368

See application file for complete search history.

(56) References Cited

U.S. PATENT DOCUMENTS 1,860,367 A * 5/1932 Peverley ..... 454/365
2,214,183 A * 9/1940 Seymour ..... 52/95
2,232,027 A * 2/1941 Gunter ..... 454/363
2,404,961 A * 7/1946 Hoch ..... 454/365
2,601,423 A * 6/1952 Allman et al. ..... 454/363
4,080,083 A * 3/1978 Malott ..... 403/305
4,545,291 A * 10/1985 Kutsch et al. ..... 454/365

FOREIGN PATENT DOCUMENTS

FR 2 040 034 A * 8/1980
GB 2 632 674 A1 * 12/1989

* cited by examiner

*Primary Examiner*—Robert J Canfield
(74) *Attorney, Agent, or Firm*—Posz Law Group, PLC

(57) ABSTRACT

A roof ventilation assembly has a ridge framework corresponding to a vent on a roof, a top cover, front and rear panels and two baffler assemblies. The two baffler assemblies are respectively mounted on two sides of the ridge framework leaving two gaps between the baffler assemblies and the top cover. When heated air under the roof rises, the heated air goes through the vent and out of the slots. Therefore, the heated air can be expelled by the roof ventilation assembly cheaply and easily, without requiring maintenance and external power source.

9 Claims, 4 Drawing Sheets

ROOF VENTILATION ASSEMBLY

BACKGROUND OF THE INVENTION

1. Field of the Invention

The present invention relates to a ventilation device, and more particularly to a ventilation assembly mounted on the roof to expel heated air trapped under the roof.

2. Description of Related Art

When constructing low cost buildings, especially factories or warehouses, corrugated iron is used for outside walls and a roof. However, the corrugated iron absorbs and transmits solar radiation effectively causing heated air to build up and remain trapped inside the building that is causes temperature damage to the building, goods and people inside the building. Therefore, a ventilation device is required.

With reference to FIG. 4, a conventional ventilation device for a roof has multiple vents (62) each having an exhaust fan (61). The multiple vents (62) are formed on the roof of the building (60). The exhaust fans (61) are then mounted on the roof, corresponding to the vents (62) and rotating synchronously with the vents. Under normal conditions, heated air trapped under the roof rises and turns the exhaust fans (61) that causes the vents (62) to rotate and create an air flow through the building, (as shown by arrows), to maintain a constant temperature.

When a wind blows, the vents (62) rotate and cause the exhaust fans to rotate, thereby sucking the heated air out of the building. However, many of these conventional devices need to be put on a roof to work effectively and this raises construction costs. Also, the fans use moveable parts that need replacing or servicing, especially when built in high corrosive or harsh environment, such as near the sea in humid, high temperature regions.

In addition, some of conventional vents require electronic exhaust fans (61) to increase exhausting heated air from the roof. However, the conventional ventilation device has multiple electric exhaust fans and each electric exhaust fan is driven by external power source, the cost of radiating heat is not cheap.

SUMMARY OF THE INVENTION

The main objective of the present invention is to provide a roof ventilation assembly that has low production costs to prevent heated air building up under a roof and prevent temperature damage inside a building.

The roof ventilation assembly has a ridge framework corresponding to a vent on a roof, a top cover, front and rear panels and two baffler assemblies. The two baffler assemblies are respectively mounted on two sides of the ridge framework leaving two gaps between the baffler assemblies and the top cover. When heated air under the roof rises, the heated air goes through the vent and then out of the slots. Therefore, the heated air can be expelled by the roof ventilation assembly cheaply and easily, without requiring maintenance.

Other objective, advantages and novel features of the invention will become more apparent from the following detailed description when taken in conjunction with the accompanying drawings.

DETAILED DESCRIPTION OF THE PREFERRED EMBODIMENT

Figure 1:
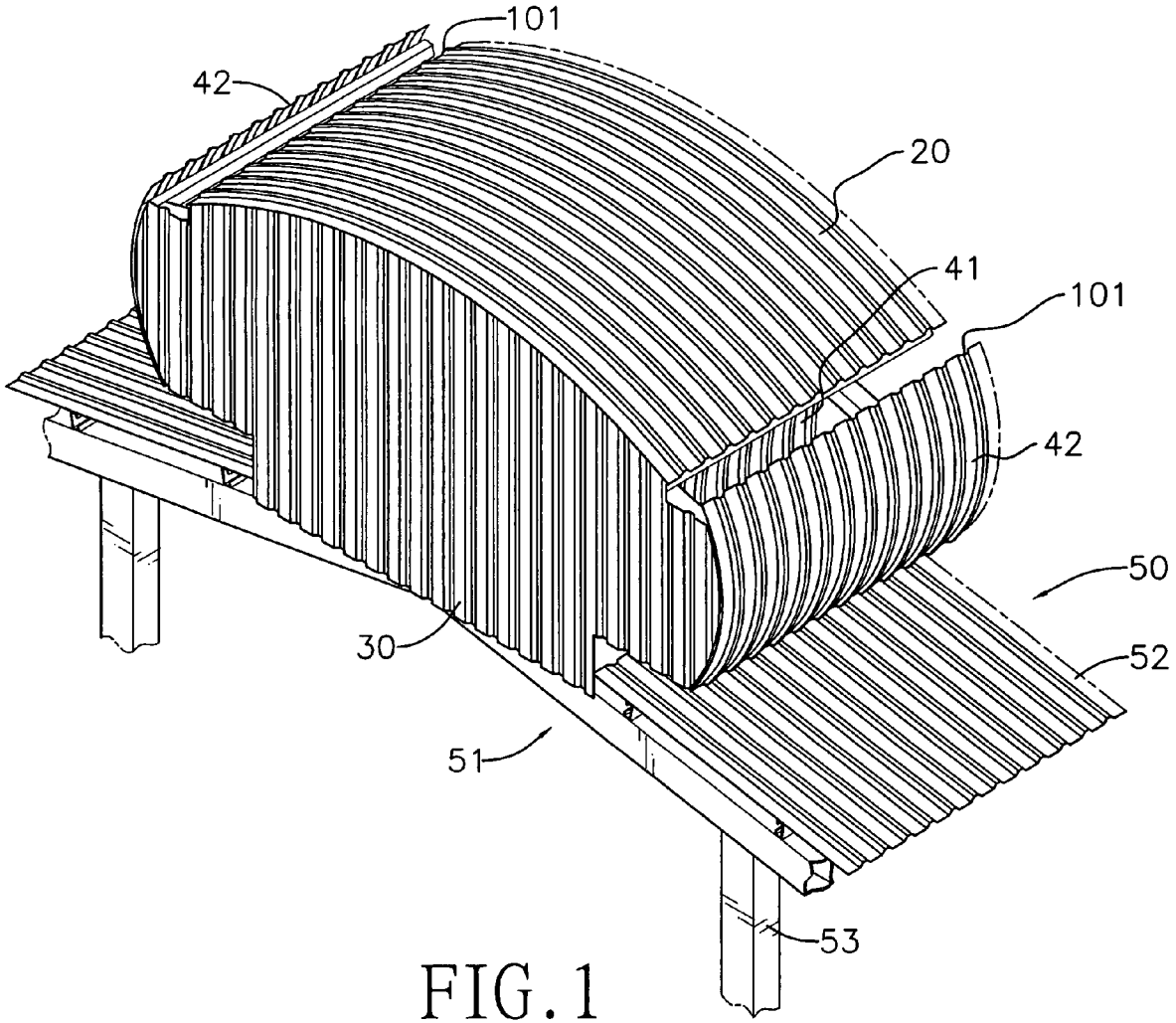
FIG. 1 is a perspective view of a roof ventilation assembly mounted on a roof in accordance with the present invention.
Figure 2:
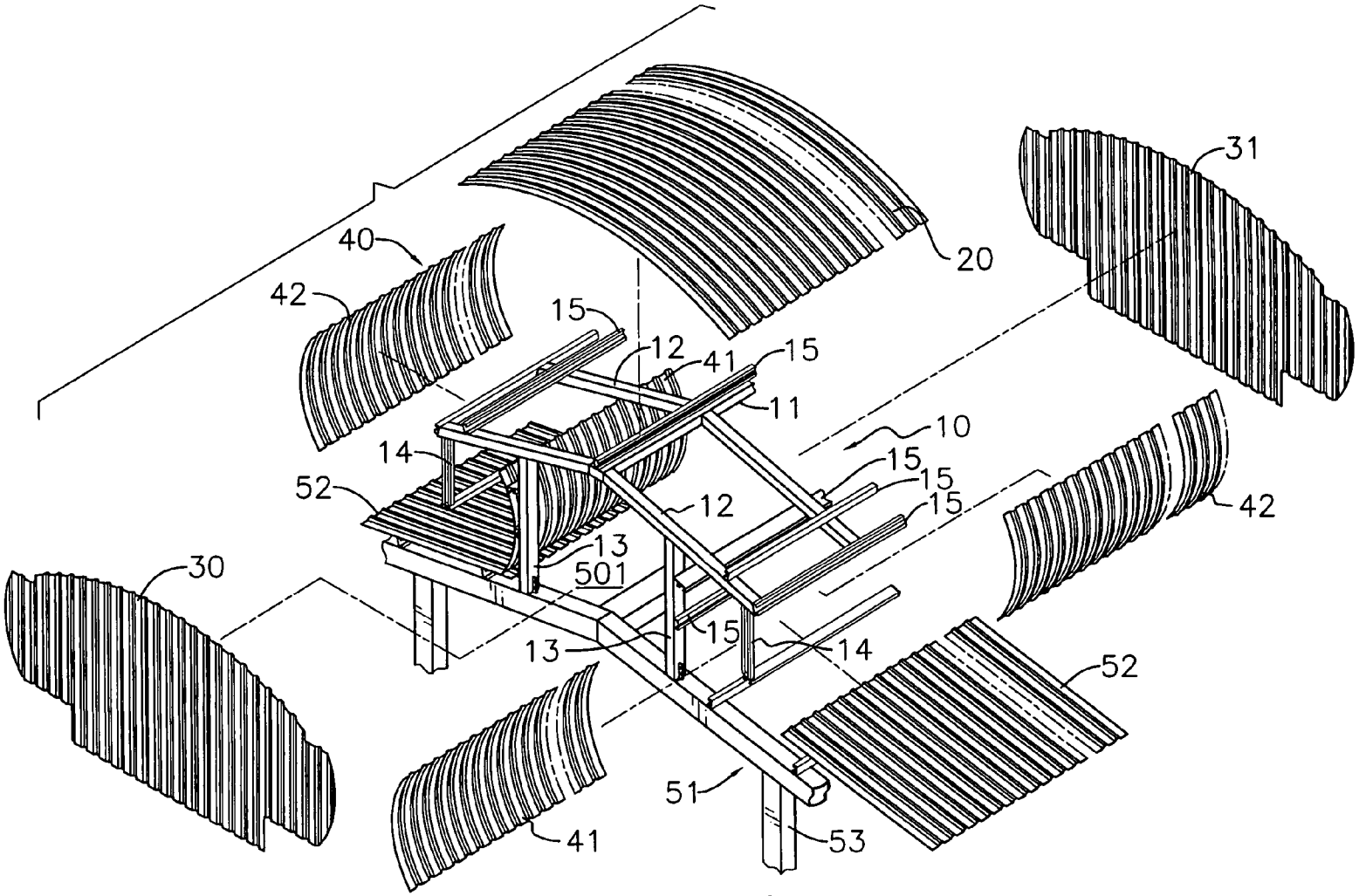
FIG. 2 is a partially exploded perspective view of the roof assembly in FIG. 1.

With reference to FIGS. 1 and 2, a roof ventilation assembly in accordance with the present invention is mounted on a roof (50) that has pairs of roof rafters (51), multiple roof panels (52), a roof ridgepole (53), and a vent (501). The roof rafters (51) are mounted at an angle to each other to form a peak and a central segment. The central segment is defined adjacent to the peak. The roof ridgepole (53) is mounted perpendicularly between the peaks of the roof rafters (51). The roof panels (52) are mounted on the roof rafters (51) to cover the roof from exterior elements but leave the central segment open. The vent is defined in central segment of the roof rafters (51) and left uncovered by the roof panels (52).

The roof ventilation assembly has a ridge framework (10), multiple optional brackets (15), a top cover (20), two baffler assemblies (40), a front panel (30) and a rear panel (31).

The ridge framework (10) has a front, a rear and two sides and comprises two trusses and a purlin (11). Each truss comprises a rafter assembly (12) and two queen posts (13) and two side supports (14). The rafter assembly (12) has two free ends and forms a peak, and may be metal, wood or plastic beams, and may be bent to form the peak or comprise two beams connected at an angle to form the peak.

The queen posts (13) are mounted between the peak and free ends of the rafter assembly (12) and on the roof rafter (51) of the roof (50), adjacent to the vent (501).

The purlin (11) is mounted between the peaks of the trusses.

The side supports (14) are mounted near both free ends of the rafter assembly (12) and parallel with the queen posts (13) and have an free end.

The brackets (15) are C-shaped in cross section, may be steel and are mounted parallelly with the purlin (11) and may be mounted adjacent to the purlin (11), near the free ends of rafter assembly (12), between the free ends of two corresponding rafter assemblies (12), between the queen posts (13) and between the free ends of two corresponding side supports (14).

Figure 3:
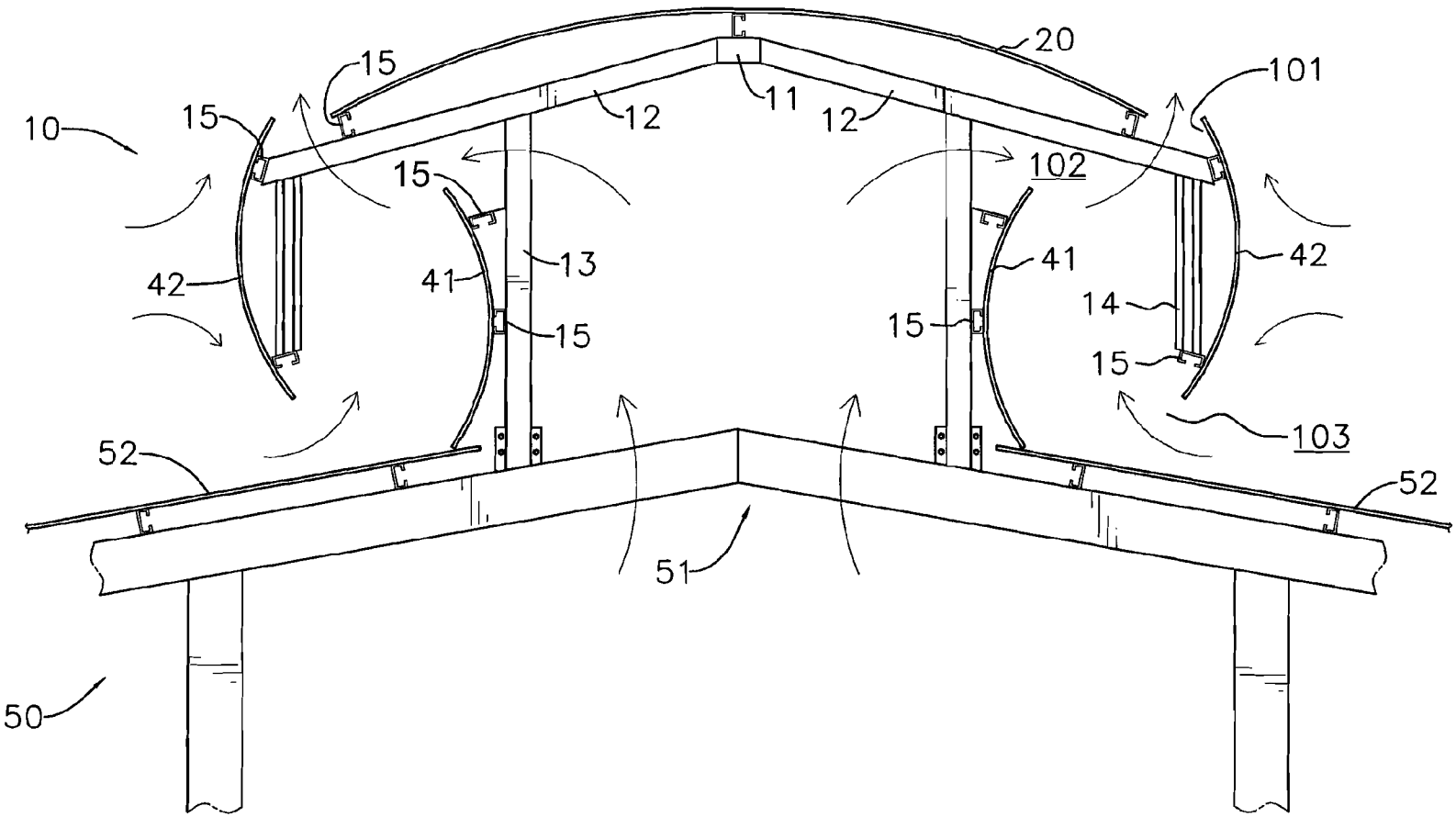
FIG. 3 is an operational front plan view in partial section of the roof assembly in FIG. 1.
Figure 4:
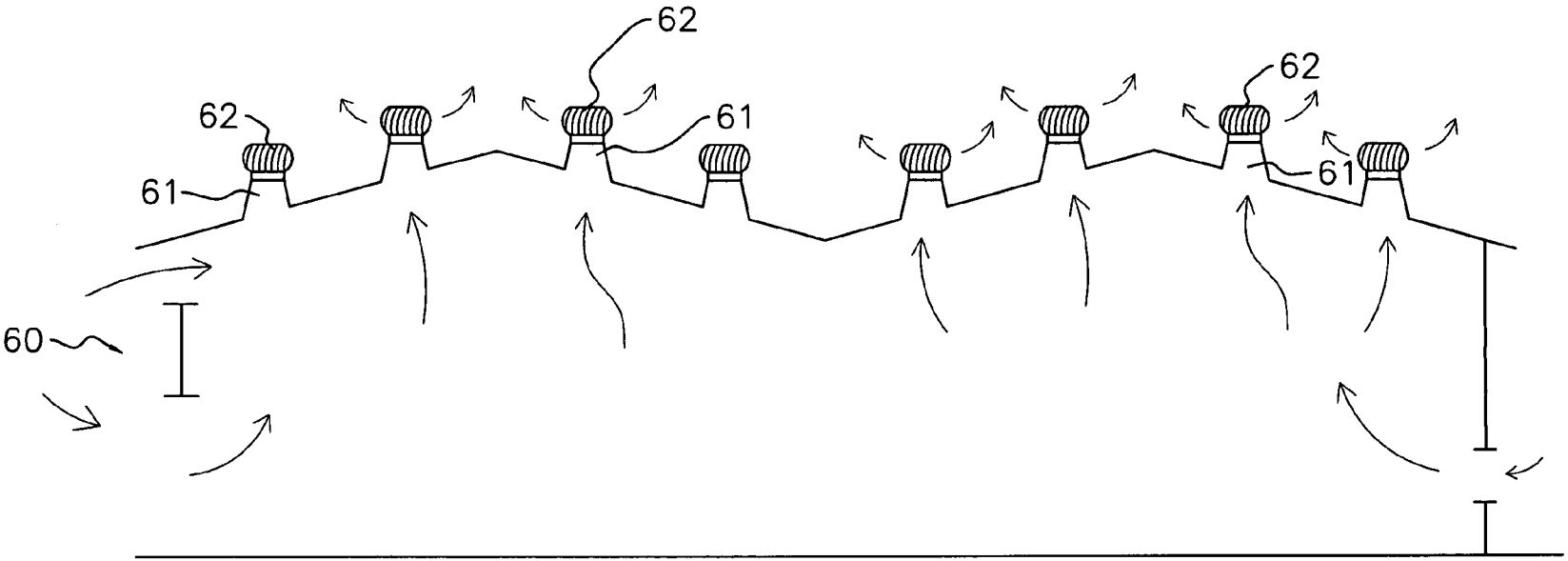
FIG. 4 PRIOR ART
FIG. 4 is a side plan view of a conventional ventilation device mounted on a roof in accordance with the prior art.

With further reference to FIG. 3, the top cover (20) is shorter than the rafter assemblies (12), is convex, may be corrugated, may be metal or plastic and has a bottom surface. The bottom surface is mounted on the purlin (11) and the rafters (12), may be using the brackets (15). Therefore, the top cover (20) defines a slot (101) near the free ends of the rafter assemblies (12). The top cover (20) is wider than the vent (501) of the roof (50).

The baffler assemblies (40) are respectively mounted on the corresponding side of the ridge framework (10) and may be corrugated metal or corrugated plastic.

The baffler assemblies (40) are mounted respectively on the corresponding side of the ridge framework (10) and each has a concave baffler (41) and a convex baffler (42). The concave baffler (41) is shorter than the queen posts (13) and has a central segment, and inner surface, a top end and a bottom end. The inner surface near the central segment of the concave baffler (41) is mounted on the corresponding queen posts (13), may be using the corresponding bracket (15). The inner surface near the top of the concave baffler (41) may be mounted to the corresponding queen posts (13), may be using the corresponding bracket (15). The bottom end is positioned on the corresponding roof panels (52). Therefore a gap (102) is defined between the top of the concave baffler (41) and the top cover (20). The convex baffler (42) is shorter than the queen posts (13) and has an inner surface. The inner surface is mounted on the corresponding free end of the corresponding rafter assemblies (12) and may be on the free end of the supports (14), may be using two brackets (15). The concave baffler (42) does not connect to the top cover (20), or cover the slot (101). Since the convex baffler (42) does not cover or contact the roof panels (52), a channel (103) is defined between the convex baffler (41), the concave baffler (42) and the roof panels (52). The front and rear panels (30, 31) are mushroom shaped to cover the front and rear of the ridge framework without covering the channel and slot (101).

When heated air builds up in the roof (50), the heated air can escape through the vent (501) of the roof and into the ventilation assembly, then rises to the top cover and then out of slot (101) between the concave baffler and the top cover. This process is accelerated when a wind blows exterior air through channel and out of the slot (101), thereby sucking the heated air out of the roof (50).

Based on the foregoing description, the roof ventilation assembly in accordance with the present invention has no moving parts, so has a lower building cost and does not require maintenance. In addition, the present invention does not require an external power source to drive to make the heated air escape from the roof.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A roof ventilation assembly comprising:

a ridge framework having a front;

a rear;

two sides;

two trusses each having a rafter assembly having two free ends and a peak; and two queen posts mounted respectively between the peak and each free end of the truss; and a purlin mounted between the peaks of the trusses;

a top cover being shorter than the rafter assemblies, convex and having a bottom surface being mounted on the purlin and rafter assemblies to define a slot near the free ends of the rafter assemblies;

two baffler assemblies mounted respectively on the corresponding side of the ridge framework and each having a concave baffler being shorter than the queen posts and having a central segment;

an inner surface near the central segment being mounted on the corresponding queen posts;

a top end being left unmounted to define a gap between the top end of the concave baffler and the top cover; and a bottom end;

a convex baffler being shorter than the queen posts and having an inner surface being mounted on the free end of the corresponding rafter;

a front panel mounted on the front end of the ridge framework; and a rear panel mounted on the rear end of the ridge framework.

2. The roof ventilation assembly as claimed in claim 1, wherein the top cover, the front wall, the rear wall and two air baffler assemblies are connected to the ridge framework by brackets.

3. The roof ventilation assembly as claimed in claim 2, wherein each bracket is C-shaped in cross section.

4. The roof ventilation assembly as claimed in claim 1, wherein each rafter assembly further comprises two side supports mounted respectively on both free ends of the rafter assembly, parallel with the queen posts and each having an free end being mounted on the inner surface of the convex baffler.

5. The roof ventilation assembly as claimed in claim 2, wherein each rafter assembly further comprises two side supports mounted respectively on both free ends of the rafter assembly, parallel with the queen posts and each having an free end being mounted on the inner surface of the convex baffler.

6. The roof ventilation assembly as claimed in claim 3, wherein each rafter assembly further comprises two side supports mounted respectively on both free ends of the rafter assembly, parallel with the queen posts and each having an free end being mounted on the inner surface of the convex baffler.

7. The roof ventilation assembly as claimed in claim 1, wherein the top cover, the front panel, the rear panel, each concave baffler and each convex baffler is corrugated.

8. The roof ventilation assembly as claimed in claim 2, wherein the top cover, the front panel, the rear panel, each concave baffler and each convex baffler is corrugated.

9. The roof ventilation assembly as claimed in claim 3, wherein the top cover, the front panel, the rear panel, each concave baffler and each convex baffler is corrugated.

* * * * *